US011647839B2

(12) United States Patent
Gillissie et al.

(10) Patent No.: US 11,647,839 B2
(45) Date of Patent: May 16, 2023

(54) ROTATING WORK SURFACE SYSTEM FOR A CHAIR

(71) Applicant: ALLSEATING CORPORATION, Mississauga (CA)

(72) Inventors: Nicholas Brian Gillissie, Toronto (CA); William James McDonald, Toronto (CA); Gary Neil, Mississauga (CA)

(73) Assignee: ALLSEATING CORPORATION

( * ) Notice: Subject to any disclaimer, the term of this patent is extended or adjusted under 35 U.S.C. 154(b) by 69 days.

(21) Appl. No.: 17/150,217

(22) Filed: Jan. 15, 2021

(65) Prior Publication Data

US 2022/0225778 A1 Jul. 21, 2022

(51) Int. Cl.
*A47C 7/68* (2006.01)
*A47C 7/54* (2006.01)

(52) U.S. Cl.
CPC ..... *A47C 7/68* (2013.01); *A47C 7/543* (2013.01)

(58) Field of Classification Search
CPC ..... A47C 3/18; A47C 7/68; A47C 7/543
See application file for complete search history.

(56) References Cited

U.S. PATENT DOCUMENTS

| | | | | |
|---|---|---|---|---|
| 4,155,593 | A * | 5/1979 | Swenson | B60N 2/38 297/344.22 |
| 9,044,099 | B2 * | 6/2015 | Bouche | A47C 7/626 |
| 9,414,686 | B1 * | 8/2016 | Corcorran | A47C 7/62 |
| 10,045,627 | B2 * | 8/2018 | Simon | A47C 7/68 |
| 10,076,976 | B2 * | 9/2018 | Roeglin | B60N 2/14 |
| 10,264,893 | B2 * | 4/2019 | Keilhauer | A47C 7/006 |
| 10,925,401 | B1 * | 2/2021 | Kassner | A47C 9/022 |
| 2009/0127908 | A1 * | 5/2009 | Kucharski | B60N 2/14 297/344.24 |
| 2016/0374879 | A1 * | 12/2016 | Christian | A47C 1/029 297/313 |
| 2019/0125085 | A1 * | 5/2019 | O'Neal | A47C 7/68 |

* cited by examiner

*Primary Examiner* — Philip F Gabler
(74) *Attorney, Agent, or Firm* — Lorelei G. Graham

(57) ABSTRACT

A rotating work surface system for a chair including a seat base having a top engaging surface, a seat support having top side and a bottom side and a rotating surface positioned in between the seat base and the seat support. The rotating surface includes a top side and a bottom side wherein the rotating surface is adapted to pivotally engage about an axis and a fixed position of the seat base and the seat support.

17 Claims, 10 Drawing Sheets

ROTATING WORK SURFACE SYSTEM FOR A CHAIR

FIELD OF THE INVENTION

This invention relates in general to seating and more particularly to a rotating work surface for a chair.

BACKGROUND OF THE INVENTION

Conventional seating arrangements for education environments and non-traditional corporate work and meeting places are typically addressed with a separate table and chair. Student desks for example, are typically arranged in a row and column configuration within a classroom. In order to provide collaborative learning and meeting, desks can be arranged in clusters in which the work surfaces of several desks are positioned together and the desk seats are positioned so that the students and participants can face each other. In another example, business meeting are often held around large conference tables with independently movable chairs spaced around the periphery of the tables. More recently conference furniture has taken a more informal approach in which the large conference table has been disposed of and replaced by individual chairs and small tables spaced about a conference space.

Altering the arrangement of the desk within a classroom or meeting room is often noisy and disruptive. Combining a chair a table arrangement is one solution, however, many of these combination possess the same disadvantages of a conventional table and chair. For example, it is difficult to transport the arrangement, the user is restricted to facing in one direction, the table can become unbalanced, and the seat is rotated about a central post so it also rotates about the table.

SUMMARY OF THE INVENTION

An object of one aspect of the present invention is to provide an improved rotating work surface system for a chair.

In accordance with one aspect of the present invention there is provided a rotating work surface system for a chair including a seat base having a top engaging surface, a seat support having top side and a bottom side and a rotating surface positioned in between the seat base and the seat support. The rotating surface includes a top side and a bottom side wherein the rotating surface is adapted to pivotally engage about an axis and a fixed position of the seat base and the seat support.

Conveniently, the seat base further includes a series of bosses extending outward from the top engaging surface of the seat base allowing for securement of the seat base to the bottom side of the seat support through the rotating surface. The rotating surface further includes a series of channels through which the series of bosses extend to engage the seat support.

Preferably, the rotating work surface system further includes a pivoting system wherein the pivoting system is adapted to adhere to the top engaging surface of the seat base in the fixed position and is adapted to adhere to the bottom side of the rotating surface so as to pivotally engage, allowing the rotating surface to rotate about the seat base.

Conveniently, the rotating surface further includes a tablet surface system. The tablet surface system further includes a vertical support member having a proximal end and a distal end, and an tablet member.

BRIEF DESCRIPTION OF THE DRAWINGS

A detailed description of the preferred embodiment(s) is(are) provided herein below by way of example only and with reference to the following drawings, in which.

Figure 1:
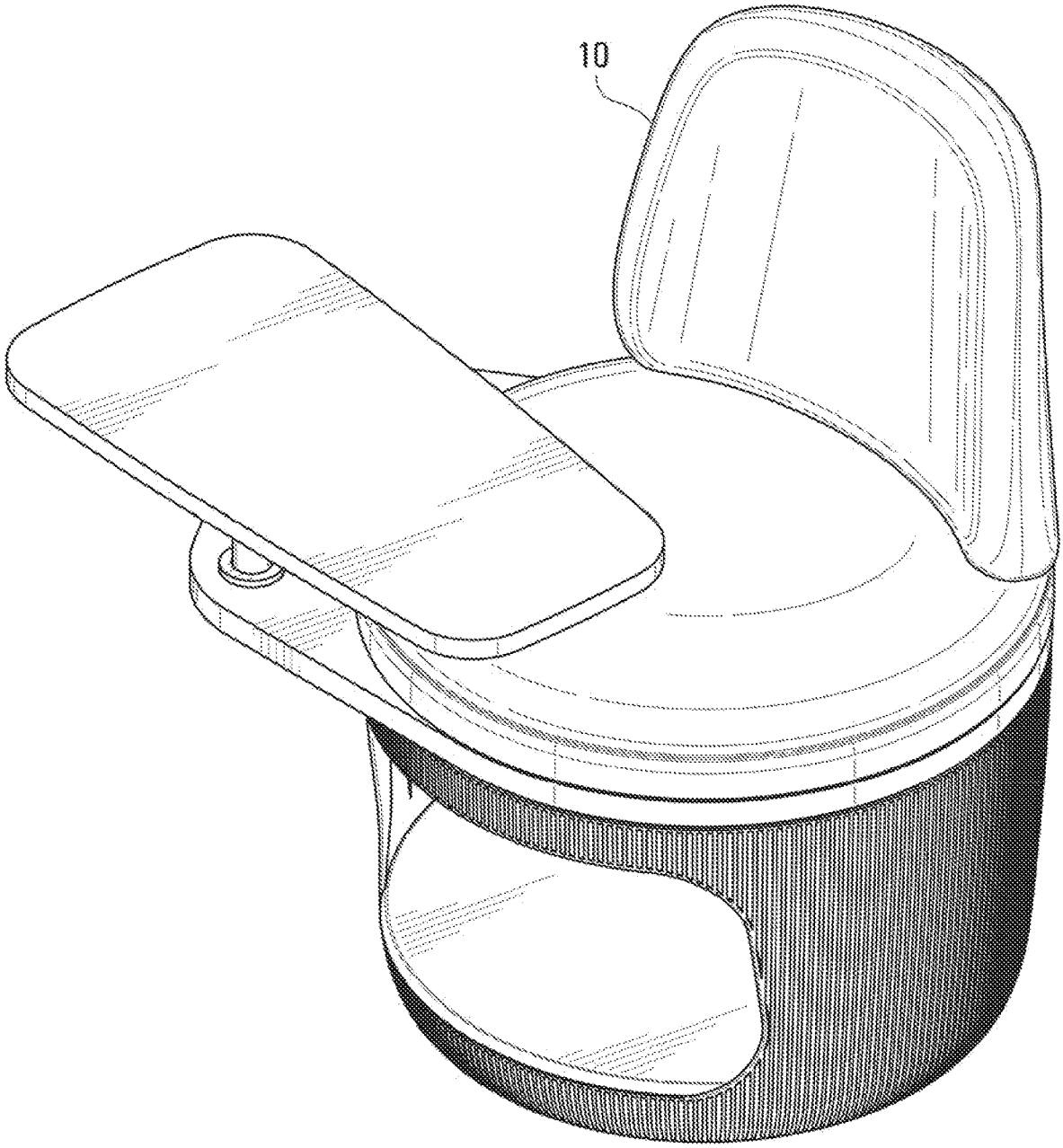
FIG. 1 in a perspective view, illustrates a rotating work surface system for a chair in accordance with the preferred embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 2:
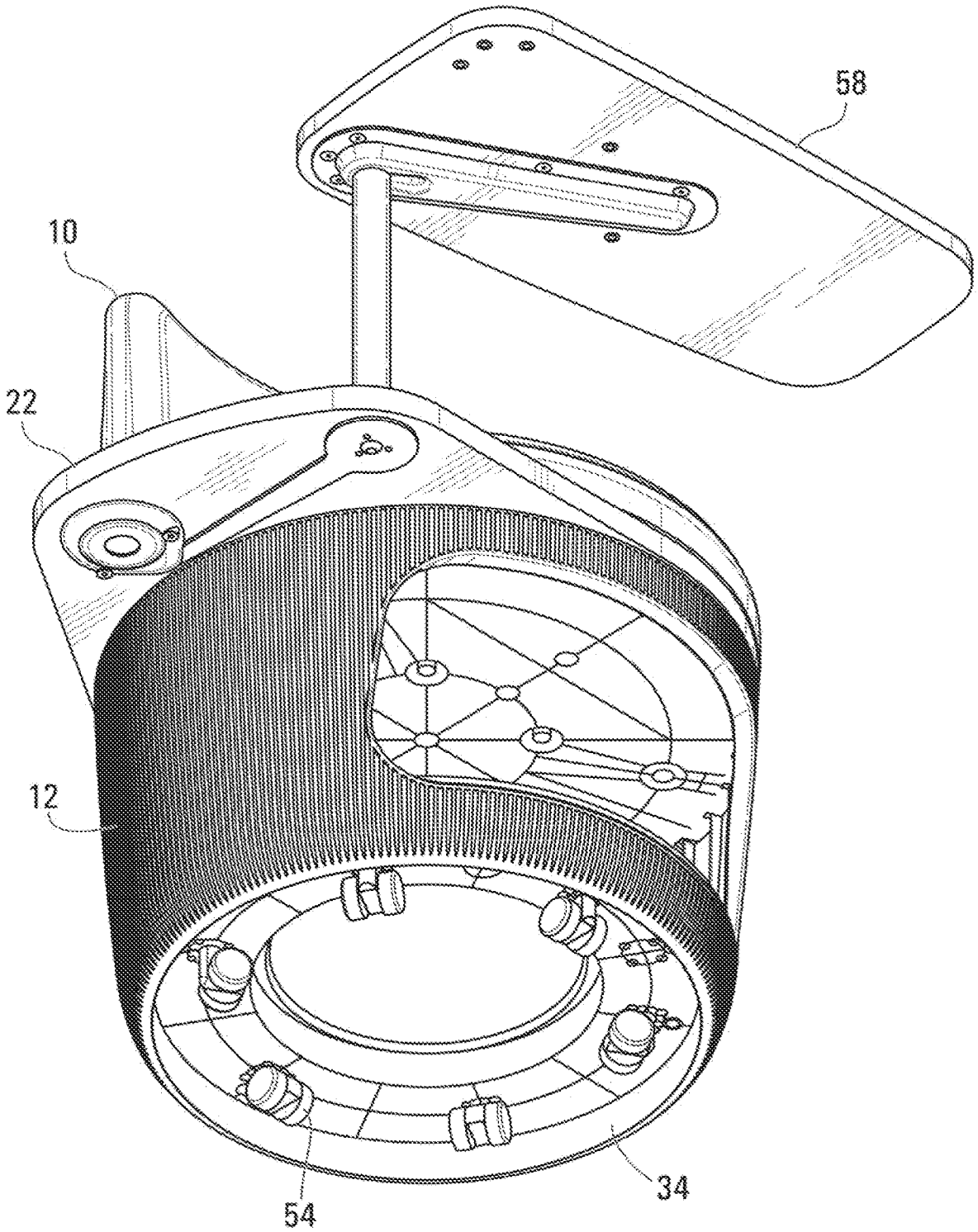
FIG. 2 in a bottom perspective view, illustrates the rotating work surface system for a chair of FIG. 1.
Figure 3:
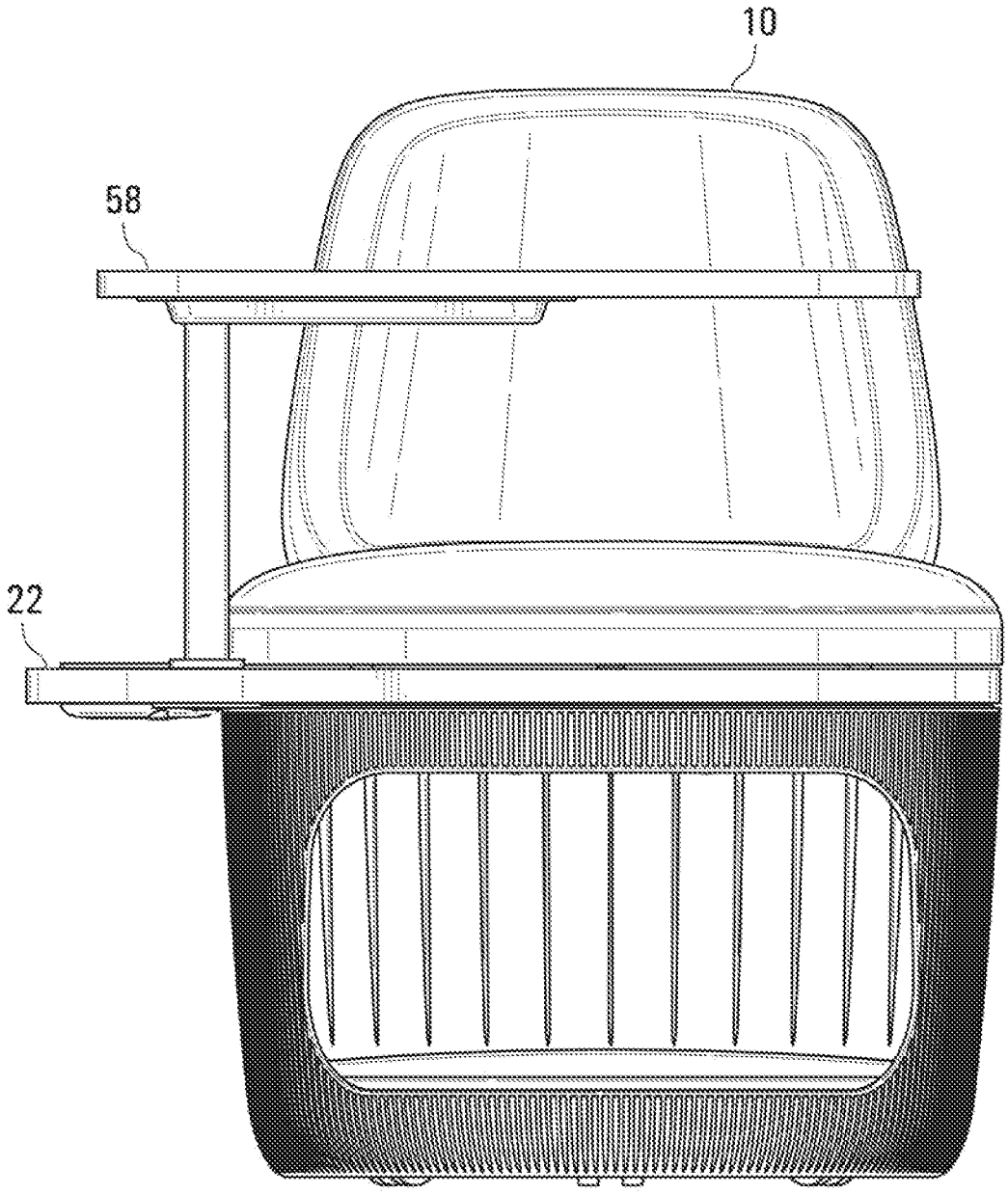
FIG. 3 in front view, illustrates the rotating work surface system for a chair of FIG. 1.
Figure 4:
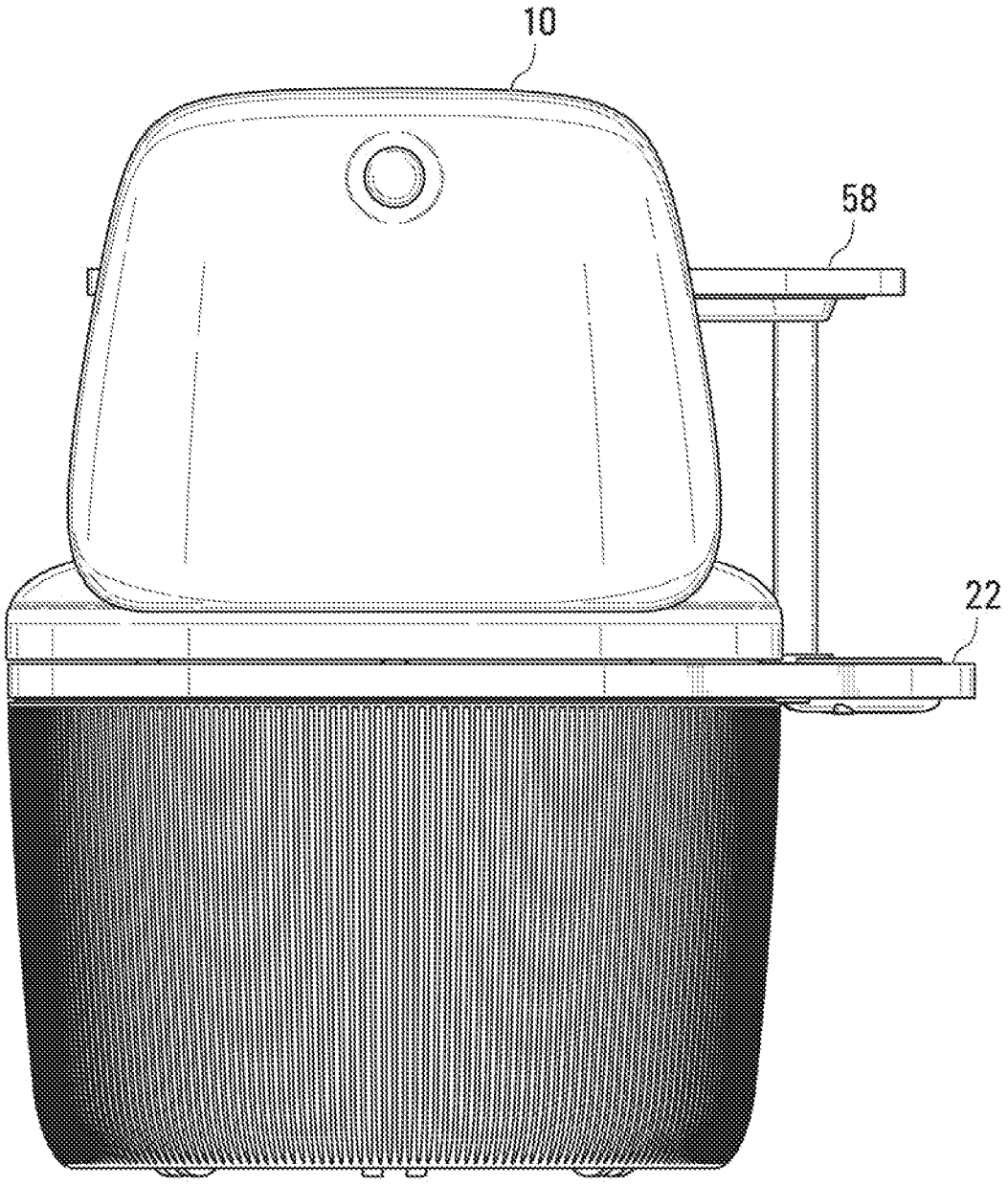
FIG. 4 in a back view, illustrates the rotating work surface system for a chair of FIG. 1.
Figure 5:
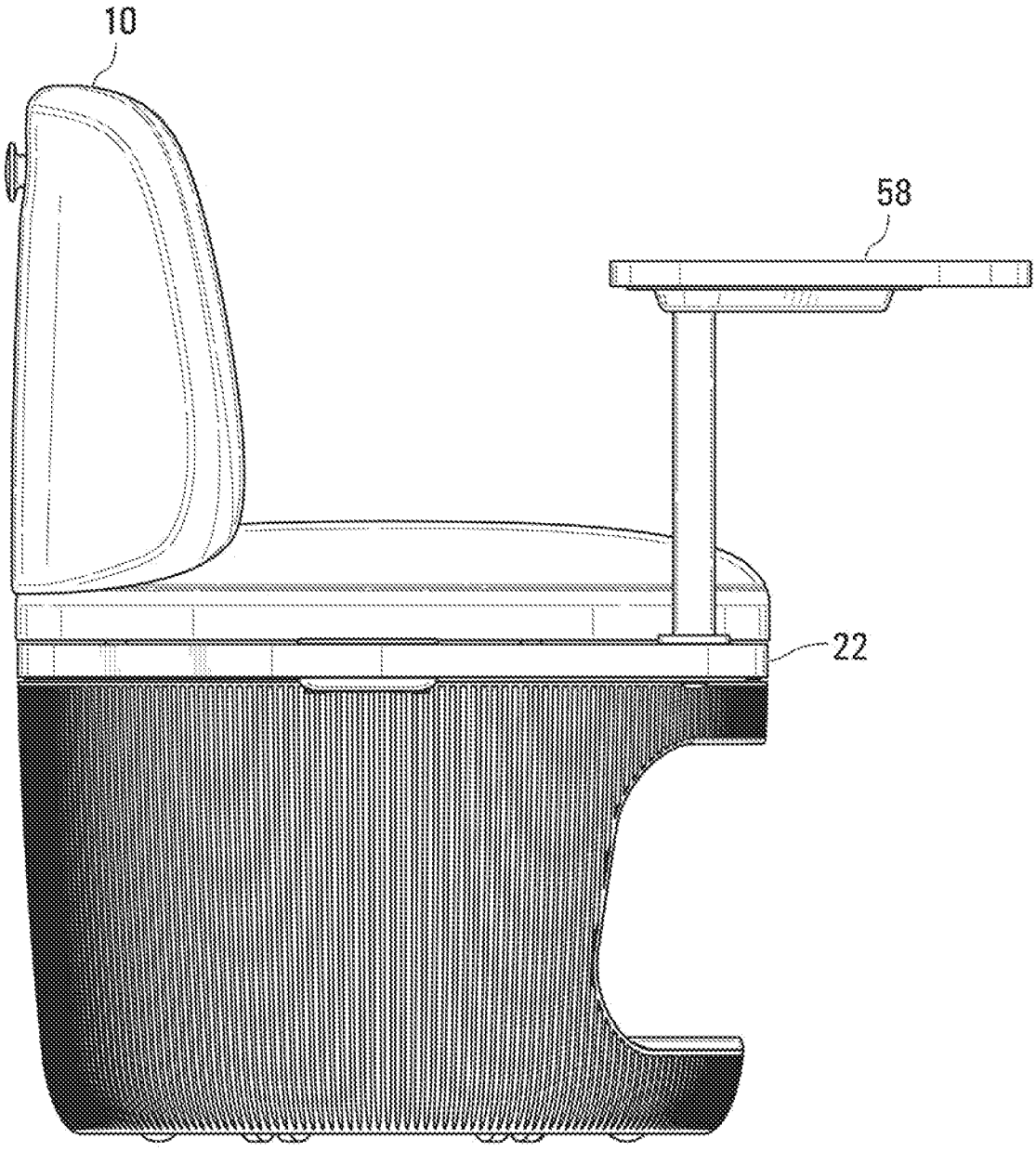
FIG. 5 in a side view, illustrates the rotating work surface system for a chair of FIG. 1.
Figure 6:
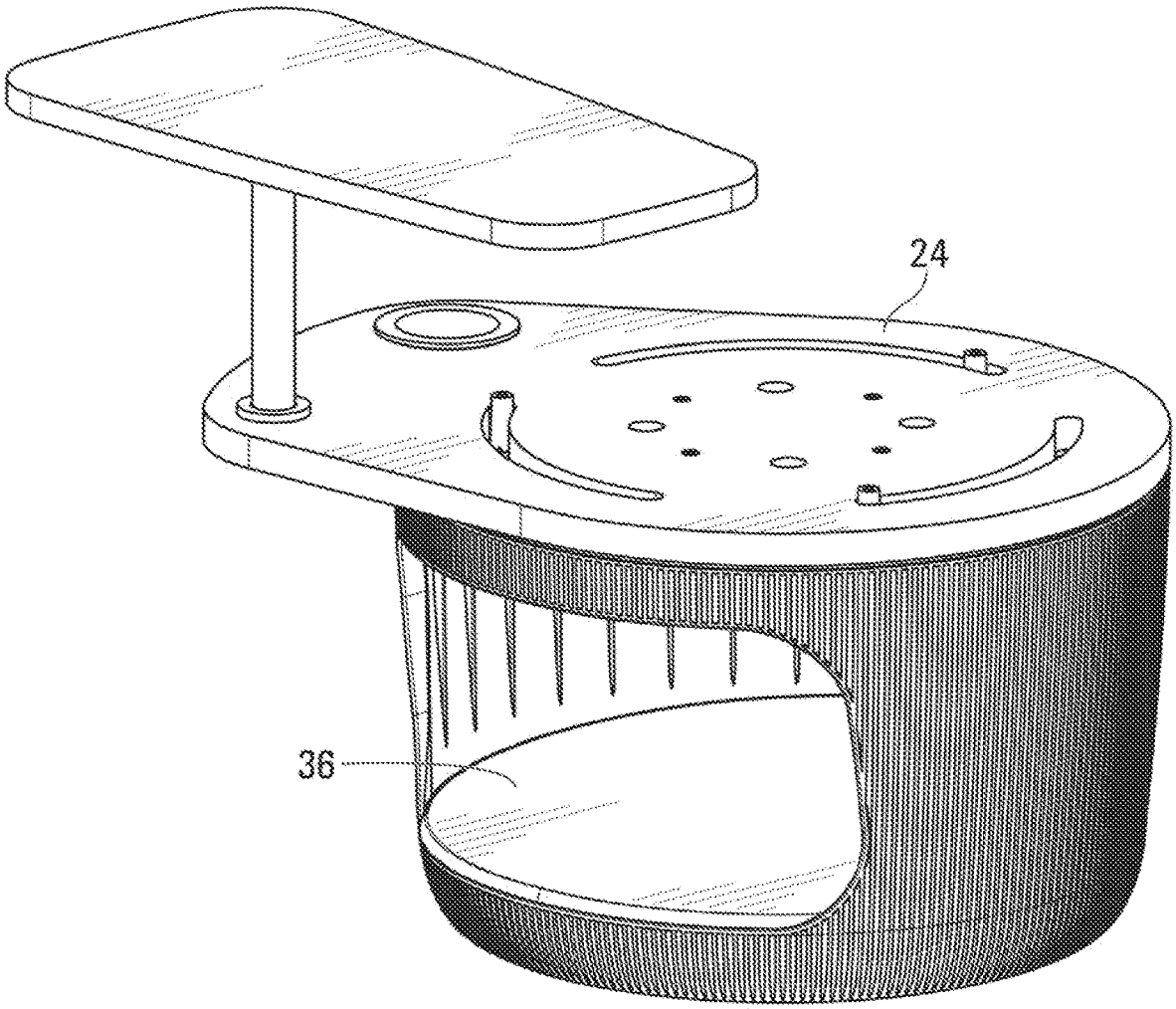
FIG. 6 in a partial perspective view, illustrates the rotating work surface system for a chair of FIG. 1.
Figure 7:
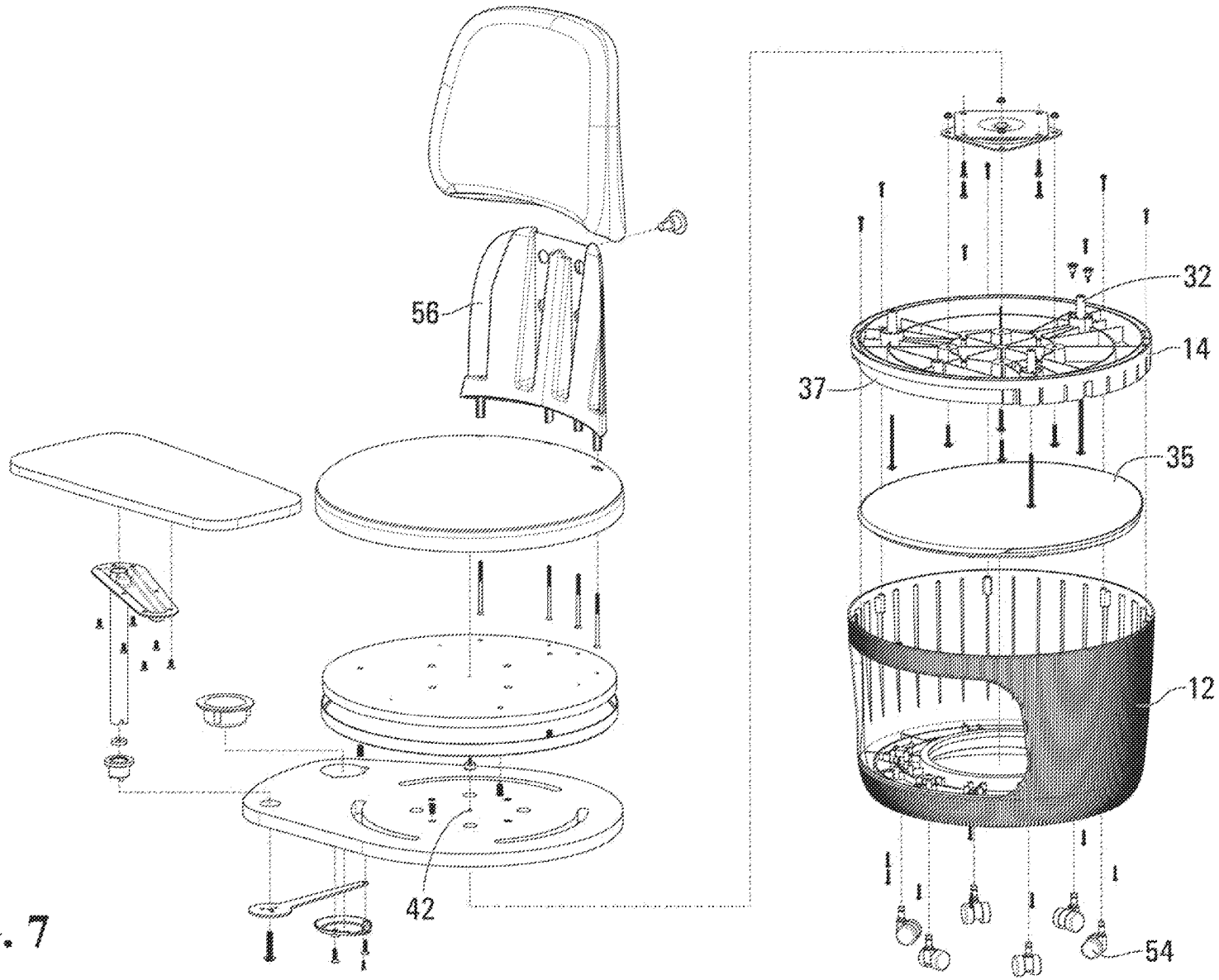
FIG. 7 in an exploded view, illustrates the rotating work surface system for a chair of FIG. 1.
Figure 8:
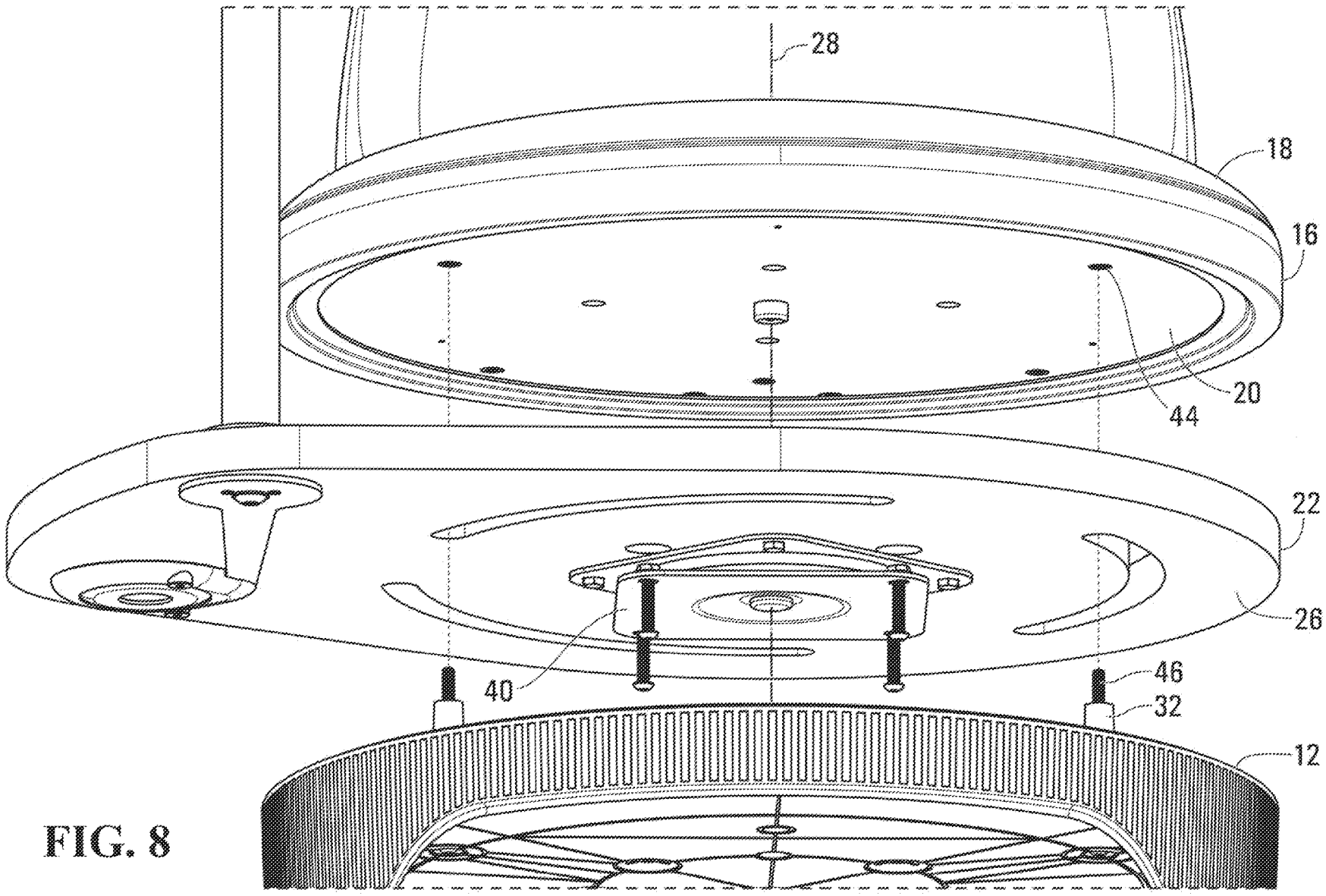
FIG. 8 in a partial exploded view, illustrates the rotating work surface system for a chair of FIG. 1.
Figure 9:
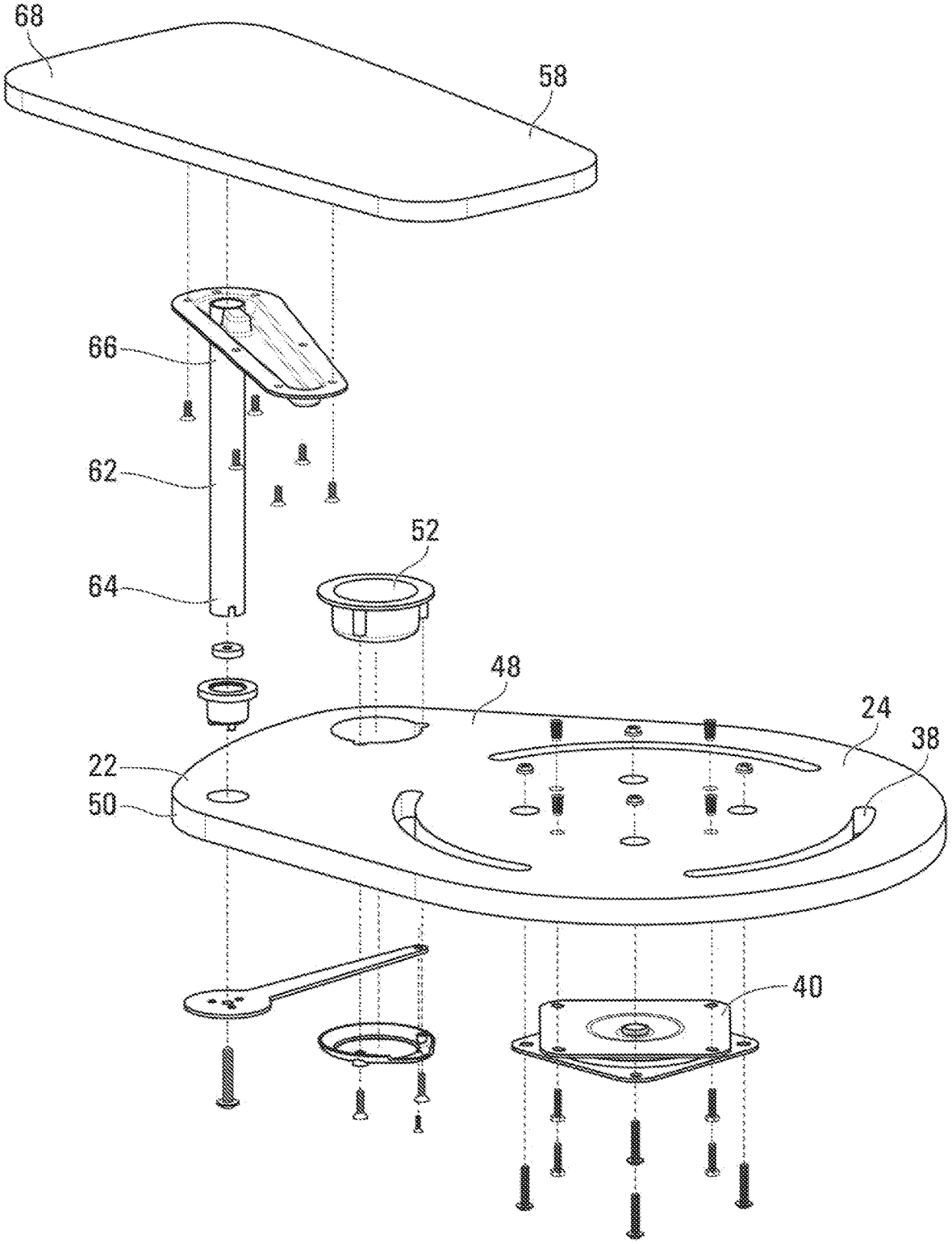
FIG. 9 in a partial exploded view, illustrates the rotating work surface system for a chair of FIG. 1.
Figure 10:
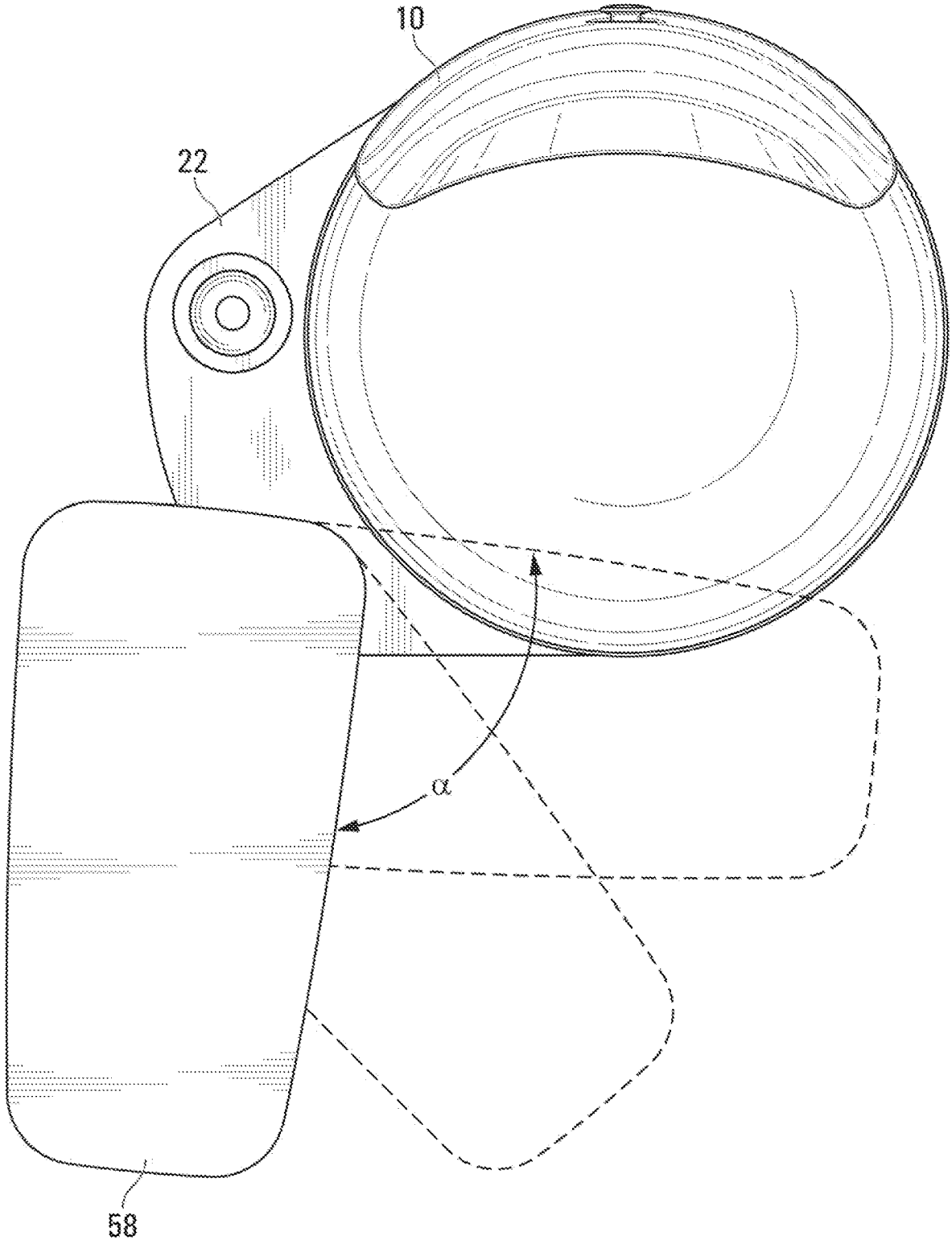
FIG. 10 in a top view, illustrates the rotation of the rotating work surface system for a chair of FIG. 1.

Referring to FIGS. 1 to 10, there is illustrated a rotating work surface system for a chair 10 in accordance with the preferred embodiment of the present invention. The rotating work surface system 10 for a chair including a seat base 12 having a top engaging surface 14, a seat support 16 having top side 18 and a bottom side 20 and a rotating surface 22 positioned in between the seat base 12 and the seat support 16. The rotating surface 22 includes a top side 24 and a bottom side 26 wherein the rotating surface 22 is adapted to pivotally engage about an axis 28 and a fixed position 30 of the seat base 12 and the seat support 16.

The seat base 12 further includes a series of bosses 32 extending outward from the top engaging surface 14 of the seat base 12 allowing for securement of the seat base 12 to the bottom side 20 of the seat support 16 through the rotating surface 22. The seat base 12 may further include a bottom engaging surface 34 and a hollow portion 36 positioned between the top engaging surface 14 and the bottom engaging surface 34. The hollow portion 36 may be used for storage when the chair is in use. This configuration of the rotating work surface system 10 for a chair is particularly useful in an education environment or meeting room, by way of example, where there is often insufficient space for a user's belongings, such as computer bags and the like.

The seat base 12 may include a base having a base pan 35 and seat mounting pan 37 adapted include the series of bosses 32. The seat mounting pan may be injection molded to include at least three (3) bosses 32. The seat base 12 to may be made from plastic, by way of example, and may have a modular shape, such as a bucket. The seat base 12 may further include a series of casters 54 that are mounted to the bottom engaging surface 34 of the seat base 12. The casters 54 allow for the easy mobility of the rotating work surface system 10 for a chair.

Referring specifically to FIGS. 6 to 10 in perspective and exploded views respectively, the rotating surface 22 further includes a series of channels 38 through which the series of bosses 32 extend to engage the seat support 16. The series of channels 38 may be co-radial and concentric to the axis 28.

The rotating work surface system 10 further includes a pivoting system 40 wherein the pivoting system 40 is adapted to adhere to the top engaging surface 14 of the seat base 16 in the fixed position 30 and is adapted to adhere to the bottom side 26 of the rotating surface 22 so as to pivotally engage about the axis 28. This configuration allows for the rotating surface 22 to rotate about the seat base 12 and the seat support 16.

The pivoting system 40 may include a swivel bearing that is adhered to the bottom side 26 of the rotating surface 22 and adhered to the top engaging surface 14 of the seat base 12. Typically the positioning of the pivoting system 40 is at a centre point 42 of the rotating surface 22 and allows for a smooth and silent operation. It may also provide for increased stability of the rotating work surface system 10 when in use, and ensures that the rotating surface 22 is not impeded during rotation and allows for large cantilever loads.

The bottom side 20 of the seat support 16 further includes a series of inserts 44 adapted to accept the series of bosses 32 once the bosses pass 32 through the series of channels 38. The connection between the seat base 12 and the seat support 16 is completed with a series of attachment mechanisms 46. The attachment mechanisms 46 pass through the series of bosses 32 and inserts 44 to securely engage the bottom side 20 of the seat support 16. The attachment mechanisms may be screws, by way of example. This connection creates the fixed position 30 of the seat base 12 and the seat support 16 relative to the rotating surface 22. The seat support 16 may further include a back support 56 mounted to bottom side 20 of the seat support 16.

When the rotating surface 22 rotates about the axis 28, the series of the channels 38 move relative to the series of bosses 32 that sit within the channels 38. As such the channels 38 accommodate the bosses 32 which remain stationary and provide for the fixed position 30 of the seat base 12 and the seat support 16.

The rotating surface 22 may further include a shelf 48 that may have a diameter that extends beyond the seat base 12 forming an extension 50. The rotating surface 22 further comprises a tablet surface system 58. The tablet surface system 58 may include a vertical support member 62 having a proximal end 64 and a distal end 66, and an tablet member 68.

The proximal end 64 of the vertical support member 62 is adapted to engage the rotating surface 22. The tablet member 68 may be adapted to engage the distal end 66 of the vertical support member 62. The engagement between the tablet member 68 with the vertical support member 62 may be either static or pivoting. The positioning of the tablet member 68 relative to the seat base 12 creates a stable and strong seat base 12 while allowing the tablet member 68 to rotate out of the seating area unimpeded. The table member 68 may include a least one recess for placement of writing implements and the like.

The shelf 48 may have a variety of functions, including but not limited to ancillary space for small electronic devices. The shelf 48 or extension 50 further include a circular-shaped recess 52. The circular-shaped recess 52 may act as a designated repository and safe placement of liquids thereby keeping the tablet surface system 58 free from possible spills.

Other variations and modifications of the invention are possible. All such modifications or variations are believed to be within the sphere and scope of the invention as defined by the claims appended hereto.

We claim:

1. A rotating work surface system for a chair, comprising:

a. a seat base having a top engaging surface wherein the seat base further comprises a series of bosses extending outward from the top engaging surface of the seat base, and a bottom engaging surface and a hollow portion with opening for storage positioned between the top engaging surface and the bottom engaging surface;

b. a seat support having top side and a bottom side;

c. a rotating surface positioned in between the seat base and the seat support, having a top side and a bottom side wherein the rotating surface is adapted to pivotally engage about an axis and a fixed position of the entire seat base and the entire bottom side of the seat support and the series of bosses allow for securement of the seat base to the bottom side of the seat support through the rotating surface; and d. a pivoting system wherein the pivoting system is adapted to adhere to the top engaging surface of the seat base in the fixed position and is adapted to adhere to the bottom side of the rotating surface so as to pivotally engage, allowing the rotating surface to rotate about the seat base.

2. A rotating work surface system for a chair as claimed in claim 1, wherein the rotating surface further comprises a series of channels through which the series of bosses extend to engage the seat support.

3. A rotating work surface system for a chair as claimed in claim 2, wherein the series of channels are co-radial and concentric to the axis.

4. A rotating work surface system for a chair as claimed in claim 3, wherein the rotating surface further comprises a center point and the pivoting system is positioned at the center point so as to rotate around the axis.

5. A rotating work surface system for a chair as claimed in claim 4, wherein the bottom side of the seat support further comprises a series of inserts adapted to accept the series of bosses once the bosses pass through the series of channels.

6. A rotating work surface system for a chair as claimed in claim 5, wherein the rotating work surface system further comprises attachment mechanisms, wherein the attachment mechanisms pass through the series of bosses and inserts to securely engage the bottom side of the seat support to create the fixed position.

7. A rotating work surface system for a chair as claimed in claim 6, wherein the seat support further comprises a back support mounted to the bottom side of the seat support.

8. A rotating work surface system for a chair as claimed in claim 7, wherein the rotating surface is a shelf having a diameter that extends beyond the seat base forming an extension.

9. A rotating work surface system for a chair as claimed in claim 8, wherein the extension further comprises a circular-shaped recess.

10. A rotating work surface system for a chair as claimed in claim 9, wherein the seat base further comprises a series of casters.

11. A rotating work surface system for a chair as claimed in claim 7, wherein the rotating surface further comprises a tablet surface system.

12. A rotating work surface system for a chair as claimed in claim 11, wherein the tablet surface system further comprises a vertical support member having a proximal end and a distal end, and an tablet member.

13. A rotating work surface system for a chair as claimed in claim 12, wherein the proximal end of the vertical support member is adapted to engage the rotating surface.

14. A rotating work surface system for a chair as claimed in claim 13, wherein the tablet member is adapted to engage the distal end of the vertical support member.

15. A rotating work surface system for a chair as claimed in claim 13, wherein the engagement between the tablet member with the vertical support member is static.

16. A rotating work surface system for a chair as claimed in claim 14, wherein the engagement between the tablet member with the vertical support member is pivoting.

17. A rotating work surface system for a chair as claimed in claim 11, wherein the tablet member further comprises a recess.

* * * * *